US010847070B2

(12) United States Patent
Lee et al.

(10) Patent No.: US 10,847,070 B2
(45) Date of Patent: Nov. 24, 2020

(54) DATA DRIVER CIRCUIT, DISPLAY PANEL, AND DISPLAY DEVICE

(71) Applicant: LG DISPLAY CO., LTD, Seoul (KR)

(72) Inventors: YongDuk Lee, Gyeonggi-do (KR); YongJoon Heo, Seoul (KR)

(73) Assignee: LG DISPLAY CO., LTD, Seoul (KR)

( * ) Notice: Subject to any disclaimer, the term of this patent is extended or adjusted under 35 U.S.C. 154(b) by 19 days.

(21) Appl. No.: 16/403,023

(22) Filed: May 3, 2019

(65) Prior Publication Data

US 2019/0340966 A1 Nov. 7, 2019

(30) Foreign Application Priority Data

May 4, 2018 (KR) ..... 10-2018-0051910

(51) Int. Cl.

| | |
|---|---|
| ***G09G 3/00*** | (2006.01) |
| ***G09G 3/36*** | (2006.01) |
| ***G09G 3/3266*** | (2016.01) |
| ***G09G 3/3275*** | (2016.01) |
| ***G09G 3/32*** | (2016.01) |

(52) U.S. Cl.

CPC ..... *G09G 3/006* (2013.01); *G09G 3/3266* (2013.01); *G09G 3/3275* (2013.01); *G09G 3/3677* (2013.01); *G09G 3/3688* (2013.01); *G09G 3/32* (2013.01); *G09G 3/3614* (2013.01); *G09G 2310/0254* (2013.01); *G09G 2330/045* (2013.01); *G09G 2330/08* (2013.01); *G09G 2330/12* (2013.01)

(58) Field of Classification Search

USPC ..... 345/214

See application file for complete search history.

(56) References Cited

U.S. PATENT DOCUMENTS

| | | | | |
|---|---|---|---|---|
| 2005/0122321 | A1* | 6/2005 | Akai | G09G 3/3688 345/204 |
| 2006/0152453 | A1* | 7/2006 | Hashimoto | G09G 3/3283 345/77 |
| 2012/0050249 | A1* | 3/2012 | Jin | G09G 3/20 345/212 |
| 2012/0293562 | A1* | 11/2012 | Park | G09G 3/3233 345/690 |
| 2014/0176525 | A1* | 6/2014 | Woo | G09G 3/3233 345/212 |
| 2016/0351095 | A1* | 12/2016 | Tani | G09G 3/3283 |
| 2017/0192065 | A1* | 7/2017 | Lee | G09G 3/3283 |
| 2018/0012553 | A1* | 1/2018 | Kim | G09G 3/3648 |

(Continued)

*Primary Examiner* — Chineyere D Wills-Burns

(74) *Attorney, Agent, or Firm* — Polsinelli PC

(57) ABSTRACT

A display device includes a display panel in which a plurality of gate lines, a plurality of data lines, and a plurality of subpixels are disposed; a gate driver circuit driving the plurality of gate lines; and a data driver circuit driving the plurality of data lines, wherein the data driver circuit outputs a detection set voltage to at least one data line among the plurality of data lines during a blank period, and the detection set voltage is higher than a detection reference voltage, and wherein the data driver circuit stops outputting a data voltage to the at least one data line during at least one period of active periods after the blank period if a voltage of the at least one data line which the detection set voltage is supplied to be lower than the detection reference voltage during the blank period.

20 Claims, 15 Drawing Sheets

(56) References Cited

U.S. PATENT DOCUMENTS

| | | | | |
|---|---|---|---|---|
| 2018/0061292 | A1* | 3/2018 | Hong | G09G 3/3233 |
| 2018/0061296 | A1* | 3/2018 | Shim | G09G 3/3275 |
| 2019/0122611 | A1* | 4/2019 | Nam | G09G 3/3258 |
| 2019/0122616 | A1* | 4/2019 | Lee | G09G 3/3233 |
| 2019/0156716 | A1* | 5/2019 | Kim | G09G 3/006 |
| 2019/0213936 | A1* | 7/2019 | Cho | H01L 27/1244 |

* cited by examiner

DATA DRIVER CIRCUIT, DISPLAY PANEL, AND DISPLAY DEVICE

CROSS-REFERENCE TO RELATED APPLICATION

This application claims priority to Korean Patent Application No. 10-2018-0051910, filed on May 4, 2018, which is hereby incorporated by reference in its entirety for all purposes as if fully set forth herein.

BACKGROUND

Field of the Disclosure

The present disclosure relates to a display device, more particularly, to a data driver circuit, a display panel, and a display device.

Description of the Background

In response to the advent of the information society, demand for display devices for displaying images has increased. In this regard, a range of display devices, such as liquid crystal display (LCD) devices, plasma display devices, and organic light-emitting diode (OLED) display devices, have recently come into widespread use.

Such a display device may include a display panel in which a plurality of gate lines, a plurality of data lines, and a plurality of subpixels, defined by intersections of the plurality of gate lines and the plurality of data lines, are disposed. The display device further includes a variety of driver circuits, such as a gate driver circuit and a data driver circuit, to drive the gate lines, the data lines, and the like.

The gate driver circuit drives the gate lines by outputting a scan signal to the plurality of gate lines. The data driver circuit supplies data voltages to the plurality of data lines at points in time at which the scan signal is applied, so that the plurality of subpixels can display an image by representing brightness levels corresponding to the data voltages.

Accordingly, signal lines, including a gate line, a data line, and the like, may be disposed in each of the subpixels disposed in the display panel. In addition, electrodes to which voltages, signals, and the like are applied for display driving may be disposed in each of the subpixels.

In this case, when a crack is formed in the display panel by an external impact, a short-circuit can be generated among different signal lines disposed in the display panel or between a signal line and an electrode. Such a short-circuit can cause a defect in the screen and generate heat, thereby damaging the display panel, the driver circuits, and the like, which may be problematic.

SUMMARY

The present disclosure provides a data driver circuit, a display panel, and a display device that can detect a short-circuit generated between signal lines or between a signal line and an electrode in the display panel during driving of the display device.

Also, a data driver circuit, a display panel, and a display device are provided to control the operation of driver circuits, based on a short-circuit generated between signal lines or the like in the display panel, thereby protecting the driver circuits or the display panel from being damaged by the short-circuit.

According to an aspect of the present disclosure, a display device includes a display panel in which a plurality of gate lines, a plurality of data lines, and a plurality of subpixels are disposed; a gate driver circuit driving the plurality of gate lines; and a data driver circuit driving the plurality of data lines, wherein the data driver circuit outputs a detection set voltage to at least one data line among the plurality of data lines during a blank period, and the detection set voltage is higher than a detection reference voltage, and wherein the data driver circuit stops outputting a data voltage to the at least one data line during at least one period of active periods after the blank period if a voltage of the at least one data line which the detection set voltage is supplied to be lower than the detection reference voltage during the blank period.

According to another aspect of the present disclosure, a display panel includes a plurality of gate lines arranged in a single direction; a plurality of data lines intersecting the plurality of gate lines; and a plurality of subpixels defined by intersections of the plurality of gate lines and the plurality of data lines. At least one data line among the plurality of data lines may be supplied with a detection set voltage higher than a detection reference voltage during a blank period, and if a voltage level become to be lower than the detection reference voltage during the blank period, may not be supplied with a data voltage in at least one period of active periods after the blank period.

According to another aspect of the present disclosure, a data driver circuit includes: a voltage output circuit outputting a detection set voltage to at least one data line among a plurality of data lines in a blank period, the detection set voltage being higher than a detection reference voltage; a detection circuit detecting a voltage of the at least one data line, to which the detection set voltage is applied in the blank period; and a control circuit stopping output of a data voltage to the at least one data line in at least one period of active periods after the blank period if a voltage of the at least one data line, to which the detection set voltage is applied, become to be lower than the detection reference voltage during the blank period.

According to exemplary aspects, a short-circuit between a data line and another signal line or between a data line and an electrode can be detected by supplying a specific voltage to data lines and detecting a voltage change in a blank period during driving of the display device.

According to exemplary aspects, if a short-circuit between a data line and another signal line or between a data line and an electrode is detected and a predetermined condition is satisfied, the data driver circuit driving the corresponding data line is shut down, so that driver circuits or a display panel can be protected from being damaged by heat due to the short-circuit in the display panel.

BRIEF DESCRIPTION OF THE DRAWINGS

The above and other objects, features, and advantages of the present disclosure will be more clearly understood from the following detailed description when taken in conjunction with the accompanying drawings, in which.

DETAILED DESCRIPTION

Figure 1:
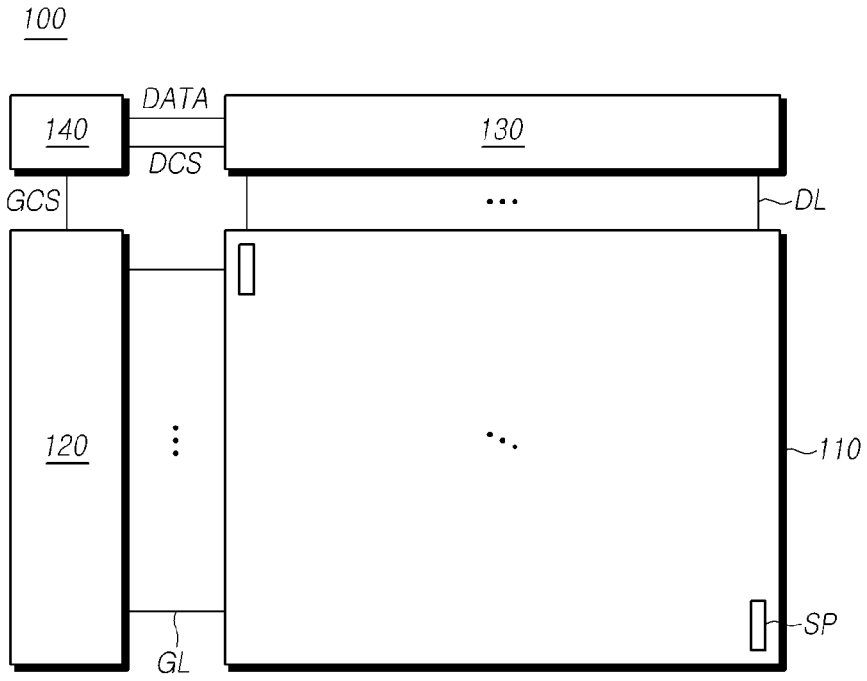
FIG. 1 is a diagram illustrating a schematic configuration of a display device according to exemplary aspects.

Hereinafter, reference will be made to aspects of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element.

FIG. 1 is a diagram illustrating a schematic configuration of a display device 100 according to exemplary aspects.

Referring to FIG. 1, the display device 100 according to exemplary aspects may include a display panel 110 in which a plurality of subpixels SP are arrayed, as well as components for driving the display panel 110, such as a gate driver circuit 120, a data driver circuit 130, and a controller 140.

In the display panel 110, a plurality of gate lines GL and a plurality of data lines DL are disposed, and the plurality of subpixels SP are disposed in areas in which the plurality of gate lines GL intersect the plurality of data lines DL.

The gate driver circuit 120 is controlled by the controller 140 to sequentially output a scan signal to the plurality of gate lines GL, disposed in the display panel 110, thereby controlling points in time at which the plurality of subpixels SP are driven.

The gate driver circuit 120 may include one or more gate driver integrated circuits (GDICs). The gate driver circuit 120 may be disposed on one side or both sides of the display panel 110, depending on the driving system. Alternatively, the gate driver circuit 120 may have a gate-in-panel structure embedded in a bezel area of the display panel 110.

The data driver circuit 130 receives image data from the controller 140 and converts the image data into analog data voltages. In addition, the data driver circuit 130 outputs the data voltages to the data lines DL, respectively, at points in time at which the scan signal is applied through the gate lines GL, so that the subpixels SP represent brightness levels corresponding to the image data.

The data driver circuit 130 may include one or more source driver integrated circuits (SDICs).

The controller 140 supplies a variety of control signals to the gate driver circuit 120 and the data driver circuit 130 to control the operations of the gate driver circuit 120 and the data driver circuit 130.

The controller 140 controls the gate driver circuit 120 to output the scan signal at points in time defined by frames. The controller 140 converts image data, received from an external source, into a data signal format readable by the data driver circuit 130, and outputs the converted image data to the data driver circuit 130.

The controller 140 receives a variety of timing signals, including a vertical synchronization signal Vsync, a horizontal synchronization signal Hsync, an input data enable signal DE, a clock signal CLK, and the like, in addition to the image data, from an external source (e.g. a host system).

The controller 140 may generate a variety of control signals using the variety of timing signals received from the external source and output the control signals to the gate driver circuit 120 and the data driver circuit 130.

For example, the controller 140 outputs a variety of gate control signals, including a gate start pulse GSP, a gate shift clock GSC, a gate output enable signal GOE, and the like, to control the gate driver circuit 120.

Here, the gate start pulse GSP controls the operation start time of the one or more GDICs of the gate circuit 120. The gate shift clock GSC is a clock signal commonly input to the one or more GDICs to control the shift time of the scan signal. The gate output enable signal GOE designates timing information of the one or more GDICs.

In addition, the controller 140 outputs a variety of data control signals, including a source start pulse SSP, a source sampling clock SSC, a source output enable signal SOE, and the like, to control the data driver circuit 130.

Here, the source start pulse SSP controls the data sampling start time of the one or more SDICs of the data driver circuit 130. The source start pulse SSP is a clock signal controlling the sampling time of data in each of the SDICs. The source output enable signal SOE controls the output time of the data driver circuit 130.

The display device 100 may further include a power management integrated circuit (PMIC) to supply various forms of voltage or current to the display panel 110, the gate driver circuit 120, the data driver circuit 130, and the like, or control various forms of voltage or current to be supplied to the same.

The subpixels SP are defined by intersections of the gate lines GL and the data lines DL. Liquid crystal or light-emitting diodes (LEDs) may be disposed in the subpixels SP, depending on the type of the display device 100.

For example, in a case in which the display device 100 is a liquid crystal display (LCD) device, the display device 100 includes a light source device, such as a backlight unit, to illuminate the display panel 110. In addition, liquid crystal is disposed in the subpixels SP of the display panel 110. It is possible to adjust the orientations of liquid crystal molecules using electric fields generated by the data voltages supplied to the subpixels SP, thereby displaying an image representing brightness levels corresponding to the image data.

Alternatively, the display device 100 may display an image by representing brightness levels corresponding to the image data using a self-emitting device. The display device 100 may include light-emitting devices, such as LEDs or organic light-emitting diodes (OLEDs), in the subpixels, respectively, and display an image by controlling current flowing through the light-emitting devices, to correspond to data voltages.

Figure 2:
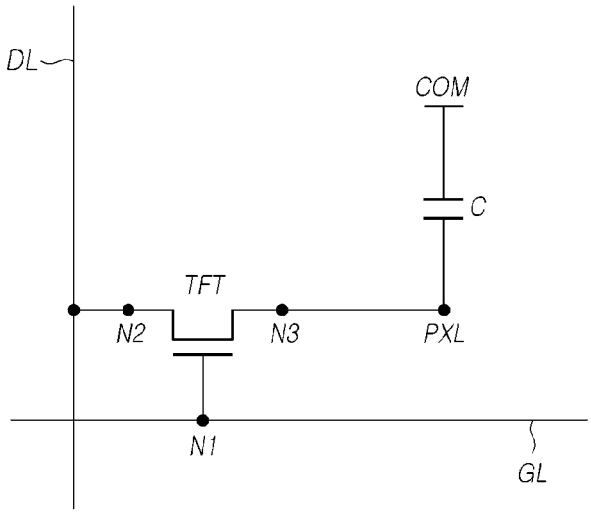
FIG. 2 is a diagram illustrating a circuit structure of a subpixel in the display device according to exemplary aspects.

FIG. 2 is a circuit diagram of a subpixel SP in the display device 100 according to exemplary aspects, in which case the display device 100 is taken as an LCD device by way of example.

Referring to FIG. 2, a single gate line GL and a single data line DL may be disposed in the subpixel SP while intersecting each other. Alternatively, two or more gate lines GL may be disposed between subpixels SP, or a single data line DL may be disposed for every two or more subpixels SP.

A thin film transistor TFT may be disposed in the subpixel SP. The thin film transistor TFT is controlled by a scan signal applied to the gate line GL, and transfers a data voltage, supplied through the data line DL, to a pixel electrode PXL. In addition, a common electrode COM, to which a common voltage is supplied, may be disposed in the subpixel SP, and capacitance C may be generated between the common electrode COM and the pixel electrode PXL.

The thin film transistor TFT may include a first node N1, a second node N2, and a third node N3.

The first node N1 may be a gate node of the thin film transistor TFT, and may be electrically connected to the gate line GL. The second node N2 may be a source node or a drain node, and may be electrically connected to the data line DL. The third node N3 may be a drain node or a source node, and may be electrically connected to the pixel electrode PXL.

The thin film transistor TFT is turned on by a scan signal having a turn-on level applied thereto through the gate line GL to direct the data voltage, supplied through the data line DL, to the pixel electrode PXL.

In addition, when the orientations of liquid crystal molecules are adjusted by electric fields generated by the data voltages supplied to the pixel electrodes PXL and the common voltages supplied to the common electrodes COM, the subpixels SP represent brightness levels corresponding to the image data, so that an image is displayed.

Figure 3:
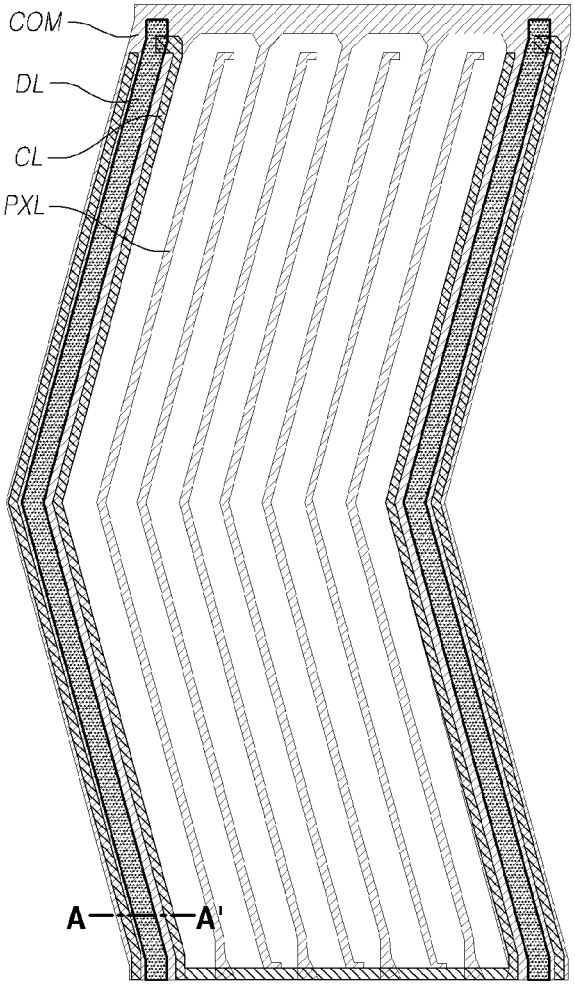
FIG. 3 is a diagram illustrating a planar structure of the subpixel in the display device according to exemplary aspects.

FIG. 3 is a diagram illustrating a planar structure of the subpixel SP in the display device 100 according to exemplary aspects. In addition, portions of the subpixel SP, on which an image is displayed, are illustrated, except for portions in which a gate line GL and a thin film transistor TFT controlling the operation of the subpixel SP are disposed.

Referring to FIG. 3, in each subpixel SP, data lines DL are arranged in one direction. Although not shown in FIG. 3, the gate line GL is arranged in a direction intersecting the data lines DL.

In addition, a common voltage line CL may be arranged in the same direction as the data lines DL.

In each subpixel SP, pixel electrodes PXL, to which data voltages are supplied through the data lines DL, and a common electrode COM, to which a common voltage VCOM is supplied through the common voltage line CL, may be disposed.

The pixel electrodes PXL and the common electrode COM may be disposed on different layers, with an insulating layer being sandwiched therebetween, or may be disposed on the same layer to form a comb-like pattern.

When data voltages corresponding to image data are supplied to the pixel electrodes PXL, the pixel electrodes PXL generate electric fields due to voltage differences from the common electrode to which the common voltage VCOM is supplied, so that subpixels SP display an image.

Although signal lines and electrodes provided in each subpixel SP may be disposed on different layers, a short-circuit may be generated between a signal line and an electrode, due to a crack formed in the display panel 110.

Figure 4A:
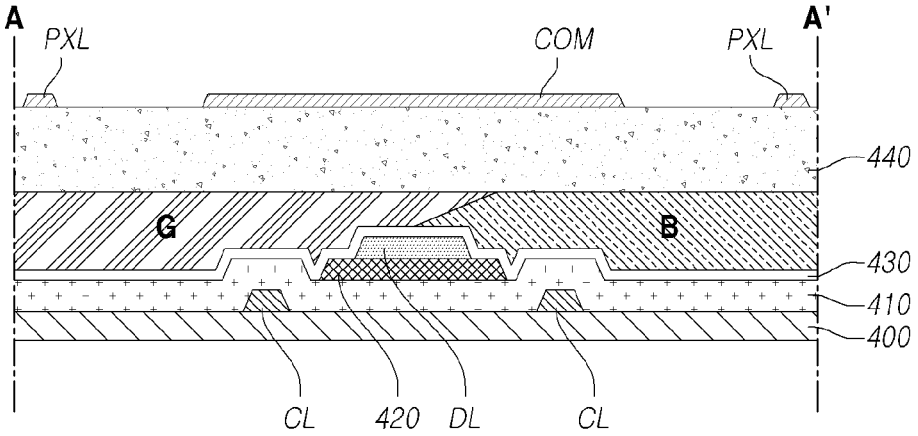
FIG. 4A is a diagram illustrating a cross-sectional structure of a region A-A' in the planar structure of the subpixel illustrated in FIG. 3.
Figure 4B:
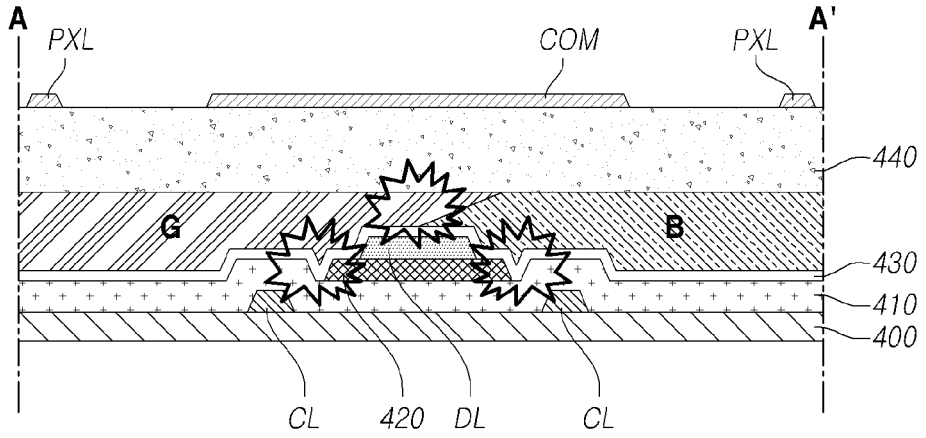
FIG. 4B is a diagram illustrating a cross-sectional structure of a region A-A' in the planar structure of the subpixel illustrated in FIG. 3.

FIGS. 4A and 4B are diagrams illustrating a cross-sectional structure of a region A-A' in the subpixel SP illustrated in FIG. 3.

Referring to FIG. 4A, a common voltage line CL is disposed on a substrate 400. The common voltage line CL may be disposed on the same layer as the gate line GL, and may be made of the same material as a gate metal of the gate line GL.

A gate insulating layer 410 may be disposed above the common voltage line CL, and an active layer 420 and a data line DL may be disposed on the gate insulating layer 410. That is, the data line DL may be disposed on a different layer from the common voltage line CL.

A passivation layer 430 may be disposed above the data line DL, and a color filter may be disposed on the passivation layer 430. In some cases, the color filter may be disposed above the pixel electrodes PXL.

A planarization layer 440 may be disposed above the color filter, and the pixel electrodes PXL and the common electrode COM may be disposed on the planarization layer 440. Alternatively, as described above, the pixel electrodes PXL and the common electrode COM may be disposed on different layers, with an insulating layer being sandwiched therebetween.

As described above, the data line DL is disposed on a different layer from either the common voltage line CL or the common electrode COM. However, if a crack is formed in the display panel 110, a short-circuit may be generated between the data line DL and the common voltage line CL or between the data line DL and the common electrode COM.

Referring to FIG. 4B, the data line DL may be short-circuited with the common voltage line CL, disposed below the data line DL, due to the crack in the display panel 110. In addition, the data line DL may be short-circuited with the gate line GL, disposed on the same layer as the common voltage line CL.

Alternatively, the data line DL may be short-circuited with the common electrode COM, disposed above the data line DL, due to the crack in the display panel 110.

Thus, if the data line DL is short-circuited with the gate line GL, the common voltage line CL, or the common electrode COM, the resistance of the data line DL may be reduced. In particular, if the data line DL is short-circuited with the common electrode COM, disposed in a wide area in the display panel 110, or the common voltage line CL, connected to the common electrode COM, the resistance of the data line DL may be reduced to a significantly small value.

If the resistance of the data line DL is reduced as described above, even in the case in which the same data voltage is supplied to the data line DL, a greater amount of current may flow to the data line DL, thereby generating heat, which is problematic. In addition, such heat may damage the display panel 110 or the driver circuits, which is problematic.

The display device 100 according to exemplary aspects can detect a short-circuit between the data line DL and another signal line or between the data line DL and an electrode and, based on the result of detection, control the operation of the data driver circuit 130. Accordingly, the driver circuits and the display panel 110 can be protected from damage due to heat generated by the short-circuit of the data line DL.

Figure 5A:
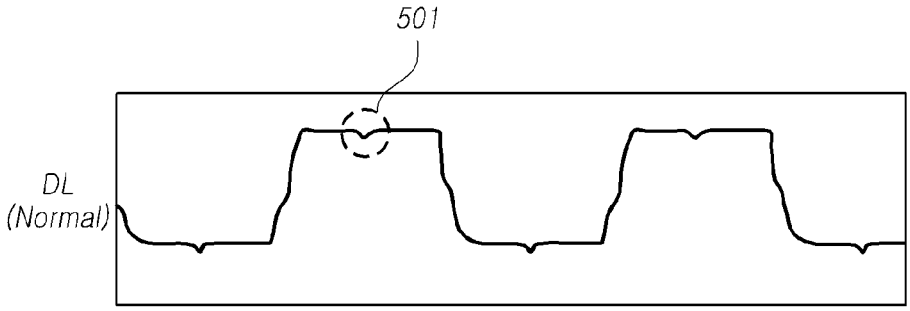
FIG. 5A is a graph respectively illustrating exemplary waveforms of data voltages supplied to the data line by the data driver circuit according to exemplary aspects.
Figure 5B:
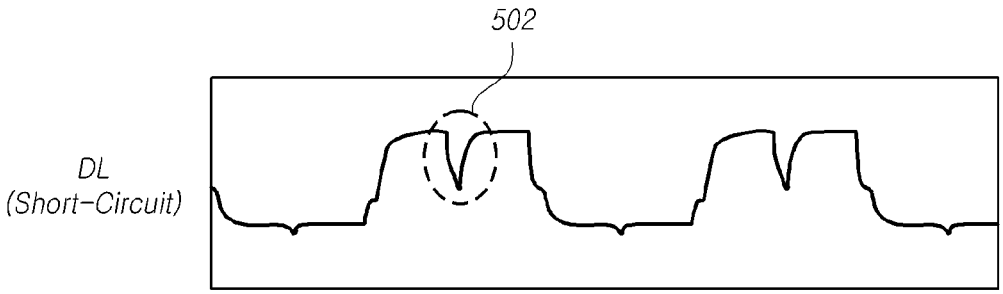
FIG. 5B is a graph respectively illustrating exemplary waveforms of data voltages supplied to the data line by the data driver circuit according to exemplary aspects.

FIGS. 5A and 5B are graphs illustrating waveforms of data voltages supplied to the data line DL by the data driver circuit 130 according to exemplary aspects.

Referring to FIGS. 5A and 5B, the data driver circuit 130 may alternately output a data voltage having a first polarity (e.g. (+) polarity) and a data voltage having a second polarity (e.g. (−) polarity) to the data line DL. For example, the data driver circuit 130 may output the data voltages by inverting the polarity thereof for every two subpixels SP.

Here, referring to a waveform of a data voltage in a normal state in which the data line DL is not short-circuited, during a blank period between periods in each of which the data voltage is supplied to the data line DL, the voltage level of the data line DL is lowered since no data voltage is supplied. However, the voltage level of the data line DL may be lowered by an insignificant degree, since the data line DL is not short-circuited (shown as 501).

In contrast, if the data line DL is short-circuited, in the blank period between the periods in which data voltages are output, a voltage that has been supplied to the data line DL may be discharged through a common electrode COM short-circuited with the data line DL. Thus, in the blank period, the voltage level of the data line DL may be lowered by a significant degree (see 502).

In particular, in the blank period between the periods in which data voltages having the same polarity are supplied, the voltage level of the data line DL may be lowered by a significant degree.

The data driver circuit 130 according to exemplary aspects may detect a degree by which the voltage level of the data line DL is lowered in the blank period between the periods in which data voltages are supplied, and may detect whether or not the data line DL is short-circuited.

However, in the case of detecting a short-circuit based on the degree by which the voltage level of the data line DL is lowered, the short-circuit may not be accurately detected, depending on the magnitude of the data voltage charged to the data line DL or the inversion of polarity.

Accordingly, the data driver circuit 130 according to exemplary aspects provides a solution able to accurately detect a short-circuit in the data line DL by supplying a specific voltage to the data line DL and detecting a voltage change in the data line DL in the blank period between the periods in which data voltages are supplied to the data line DL.

Figure 6:
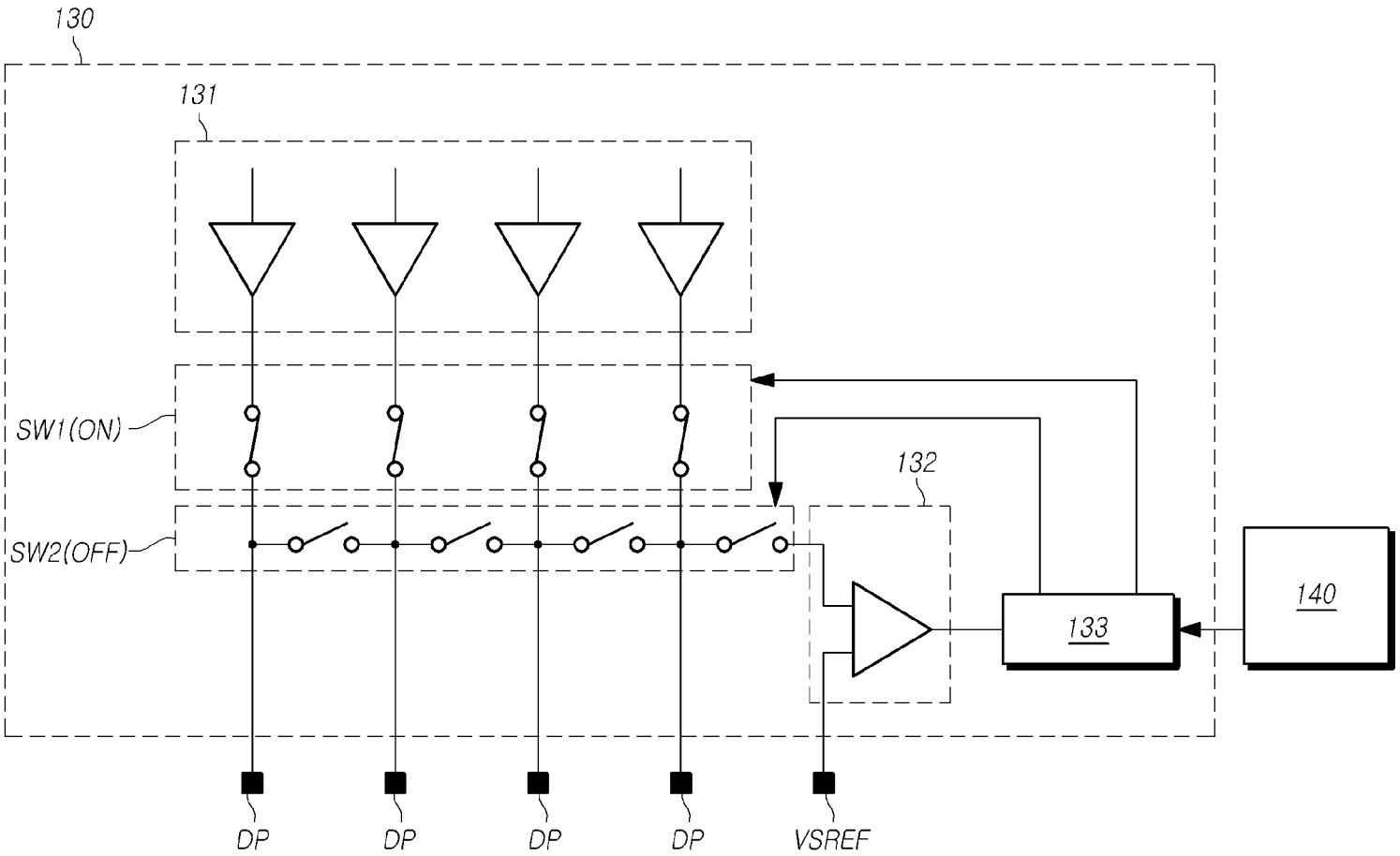
FIG. 6 is a circuit diagram illustrating a structure of the data driver circuit according to exemplary aspects.
Figure 7:
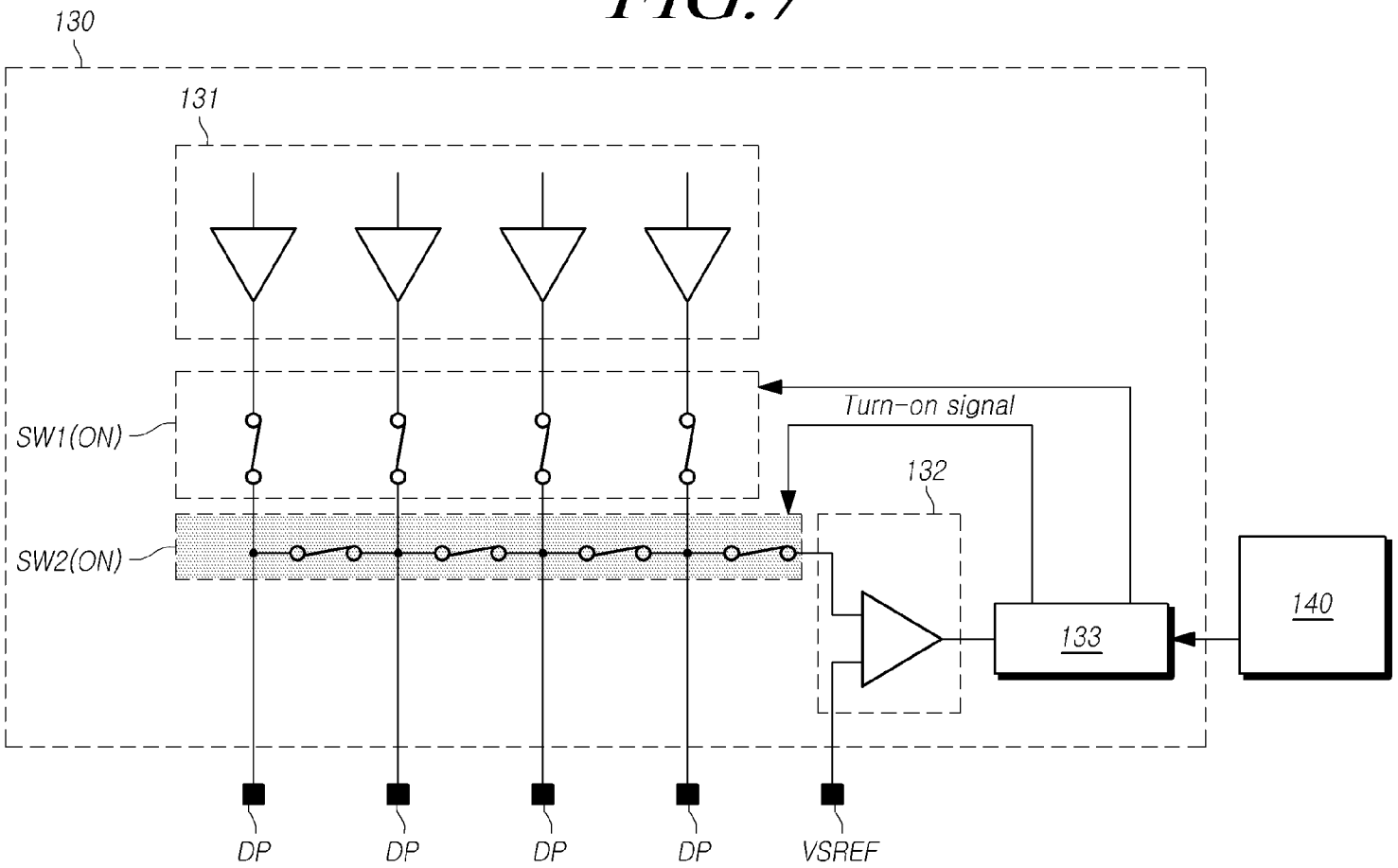
FIG. 7 is a circuit diagram illustrating an operation method by which the data driver circuit, illustrated in FIG. 6, detects a short-circuit in the data line.
Figure 8:
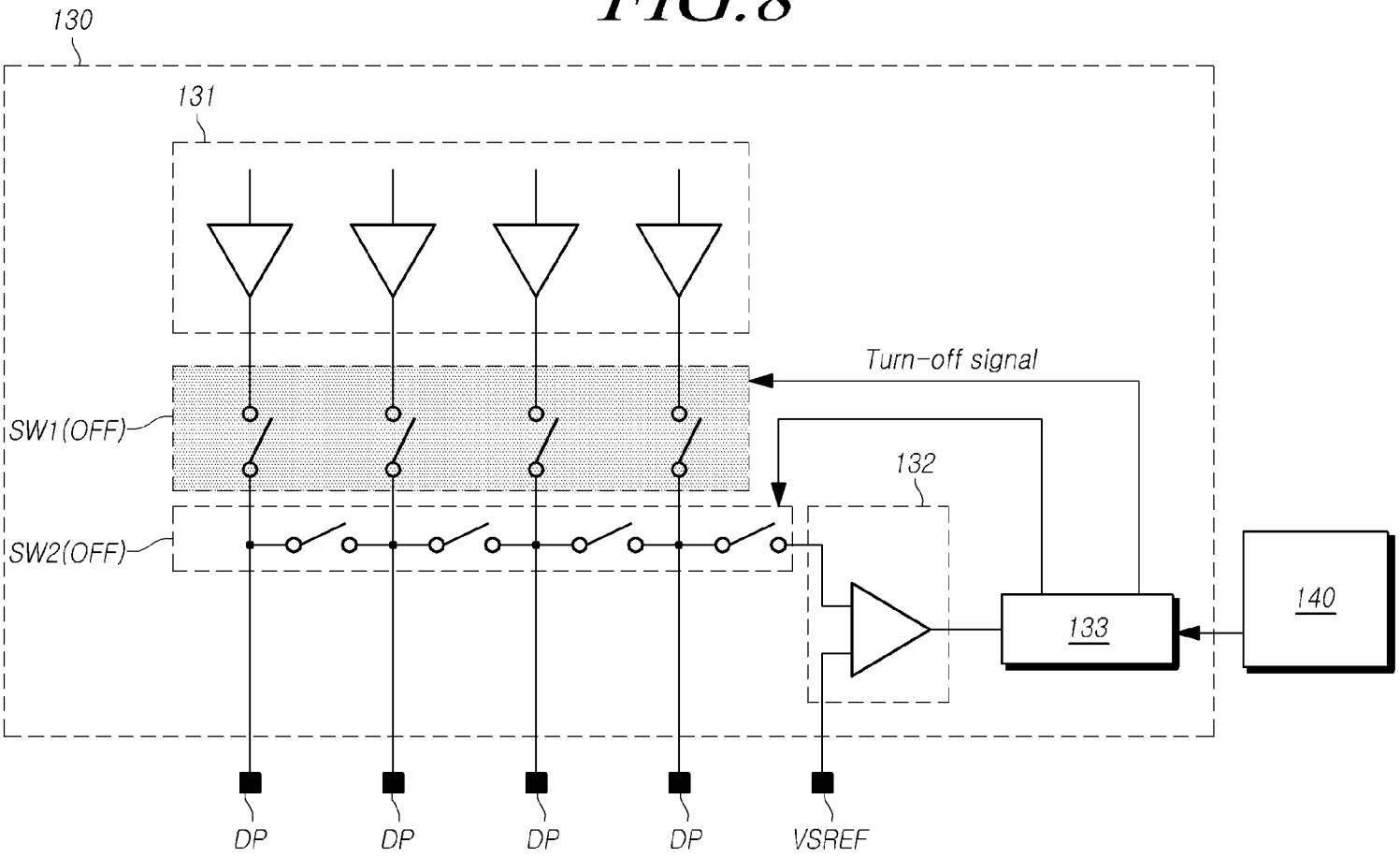
FIG. 8 is a circuit diagram illustrating an operation method by which the data driver circuit, illustrated in FIG. 6, performs a shut-down operation if a short-circuit is detected in the data line.

FIG. 6 is a circuit diagram illustrating a structure of the data driver circuit 130 according to exemplary aspects, while FIGS. 7 and 8 are circuit diagrams illustrating a method by which the data driver circuit 130, illustrated in FIG. 6, detects a short-circuit in the data line DL and controls the output of voltages.

Referring to FIG. 6, the data driver circuit 130 according to exemplary aspects may include a voltage output circuit 131, a detection circuit 132, and a control circuit 133.

In addition, the data driver circuit 130 may include first switches SW1 electrically connected between data pads DP and the voltage output circuit 131 and second switches SW2 electrically connected between the data pads DP and the detection circuit 132. Here, the data pads DP are electrically connected to data lines DL, respectively.

The voltage output circuit 131 may convert digital signals received from the controller 140, corresponding to the image data, into analog voltages, and supply the converted analog voltages to the data lines DL, respectively. In addition, the voltage output circuit 131 may output a detection set voltage VSCON to the data lines DL in the blank period, the detection set voltage VSCON being for detection of a short-circuit in the data lines DL.

The voltage output circuit 131 may include a digital analog converter (DAC) converting digital signals into analog voltages, an output buffer, and the like.

Here, the first switches SW1, electrically connecting between the voltage output circuit 131 and the data pads DP, may be maintained in a turned-on state. Thus, the first switches SW1 can allow data voltages to be supplied to the data lines DL in active periods and the detection set voltage VSCON to be supplied to the data lines DL in the blank period.

When the detection set voltage VSCON is supplied to the data lines DL in the blank period, the detection circuit 132 detects voltage changes in the data lines DL in the blank period.

As illustrated in FIG. 7, the second switches SW2, electrically connected between the data pads DP and the detection circuit 132, are maintained in a turned-on state in the blank period, so that the detection circuit 132 can detect voltage changes in the data lines DL in the blank period.

Here, the first switches SW1, electrically connecting between the voltage output circuit 131 and the data pads DP, are maintained in a turned-on state during the blank period. Thus, the detection set voltage VSCON may be supplied to the data lines DL during the blank period.

In addition, in the case in which a signal having a turn-off level has been applied to gate lines GL during the blank period, the detection set voltage VSCON supplied to the data lines DL may be gradually discharged. Degrees, by which voltages are discharged from the data lines DL, may differ, depending on a short-circuit in the data lines DL.

That is, if no short-circuit is generated in the data lines DL, a small amount of voltage may be discharged from each of the data lines DL. In contrast, if a short-circuit is generated in a data line DL among the data lines DL, a large amount of voltage may be discharged from the short-circuited data line DL, since the voltage may be discharged from the short-circuited data line DL to the common electrode COM or the like.

The detection circuit 132 may detect such a voltage change in the short-circuited data line DL, since the detection circuit 132 is connected to the data lines DL during the blank period.

The detection circuit 132 may compare a data line voltage, detected from each of the data lines DL, with a detection reference voltage VSREF, and output the result of comparison to the control circuit 133.

Here, the detection reference voltage VSREF may be a voltage lower than the detection set voltage VSCON supplied to the data lines DL in the blank period.

In addition, the detection reference voltage VSREF may be set based on a voltage supplied to a signal line or an electrode, short-circuited with the short-circuited data line DL, so that the degree of the short-circuit of the short-circuited data line DL can be determined.

For example, the detection reference voltage VSREF may be set based on a common voltage VCOM supplied to the common electrode COM.

In a case in which the detection set voltage VSCON is supplied to a data line DL among the data lines DL in the blank period, if the data line DL is not short-circuited, the voltage of the data line DL is lowered by an insignificant degree.

In contrast, if the data line DL is short-circuited, the voltage of the data line DL is lowered by a significant degree during the blank period. A short-circuit in the data line DL may be detected by comparing the voltage of the data line DL with the preset detection reference voltage VSREF.

The control circuit 133 controls the operation of the detection circuit 132 during the blank period, and detects a short-circuit in the data lines DL, based on the voltage state of the data lines DL detected by the detection circuit 132.

The control circuit 133 receives a start signal and an end signal of the blank period from the controller 140. In addition, the control circuit 133 may receive level information of the detection set voltage VSCON to be output by the controller 140 during the blank period.

In addition, during the blank period, the control circuit 133 may output a signal, by which the second switches SW2 connected between the detection circuit 132 and the data pads DP are turned on. Specifically, the control circuit 133 outputs a control signal (e.g. a high level signal), by which the second switches SW2 are turned on, to the second switches SW2 during the blank period, and outputs a control signal (e.g. a low level signal), by which the second switches SW2 are turned off, to the second switches SW2 during periods other than the blank period.

In addition, the control circuit 133 may output a signal, by which a voltage output operation of the voltage output circuit 131 is controlled, based on the result of detection by the detection circuit 132.

For example, if the voltage of the data line DL, detected by the detection circuit 132 in the blank period, becomes lower than the detection reference voltage VSREF, the control circuit 133 may output a signal, by which the voltage output operation of the voltage output circuit 131 is stopped.

Here, the control circuit 133 may output a voltage output stop signal to the voltage output circuit 131, or output a signal, by which the first switches SW1 connected between the voltage output circuit 131 and the data pads DP are turned off, as illustrated in FIG. 8.

Specifically, if a short-circuit is determined as being generated in a data line DL among the data lines DL, based on a result detected by the detection circuit 132, the control circuit 133 may output a control signal (e.g. a low level signal) to the first switches SW1, so that the first switches SW1 are turned off by the control signal. In addition, before a short-circuit in the data lines DL is detected, the control circuit 133 may output a turn-on control signal (e.g. a high level signal) to the first switches SW1, so that the first switches SW1 are maintained in a turned-on state.

Here, if the short-circuit in the short-circuited data line DL is detected a certain number of times or more by the detection circuit 132, the control circuit 133 may stop the voltage output operation of the voltage output circuit 131 to prevent unnecessary operation control over the voltage output circuit 131 due to the detection of the short-circuit. Alternatively, if the short-circuit in the short-circuited data line DL is detected has been continuously detected a certain number of times or more, the voltage output operation may be stopped.

For example, if a blank period, in which the short-circuit in the short-circuited data line DL is detected, has continued for 16 times or more, the control circuit 133 may stop the voltage output operation of the voltage output circuit 131.

As described above, the data driver circuit 130 may apply the detection set voltage VSCON to the data lines DL in the blank period and detect a voltage change in the data lines DL during the blank period, thereby detecting a short-circuit in the data line during display driving.

In addition, if the short-circuit is detected in the data line DL, the data driver circuit 130 may stop the output of a voltage to the data line DL to protect the data line DL from heat due to the short-circuit, so that none of the display panel 110 or the driver circuits is damaged.

The detection of the short-circuit in the data line DL may be performed in a blank period in which no data voltages are output. The blank period is comprised of a vertical blank period V-Blank, i.e. a period between image frames, and a horizontal blank period H-Blank, i.e. a period between periods in which data voltages are output in an image frame.

Figure 9:
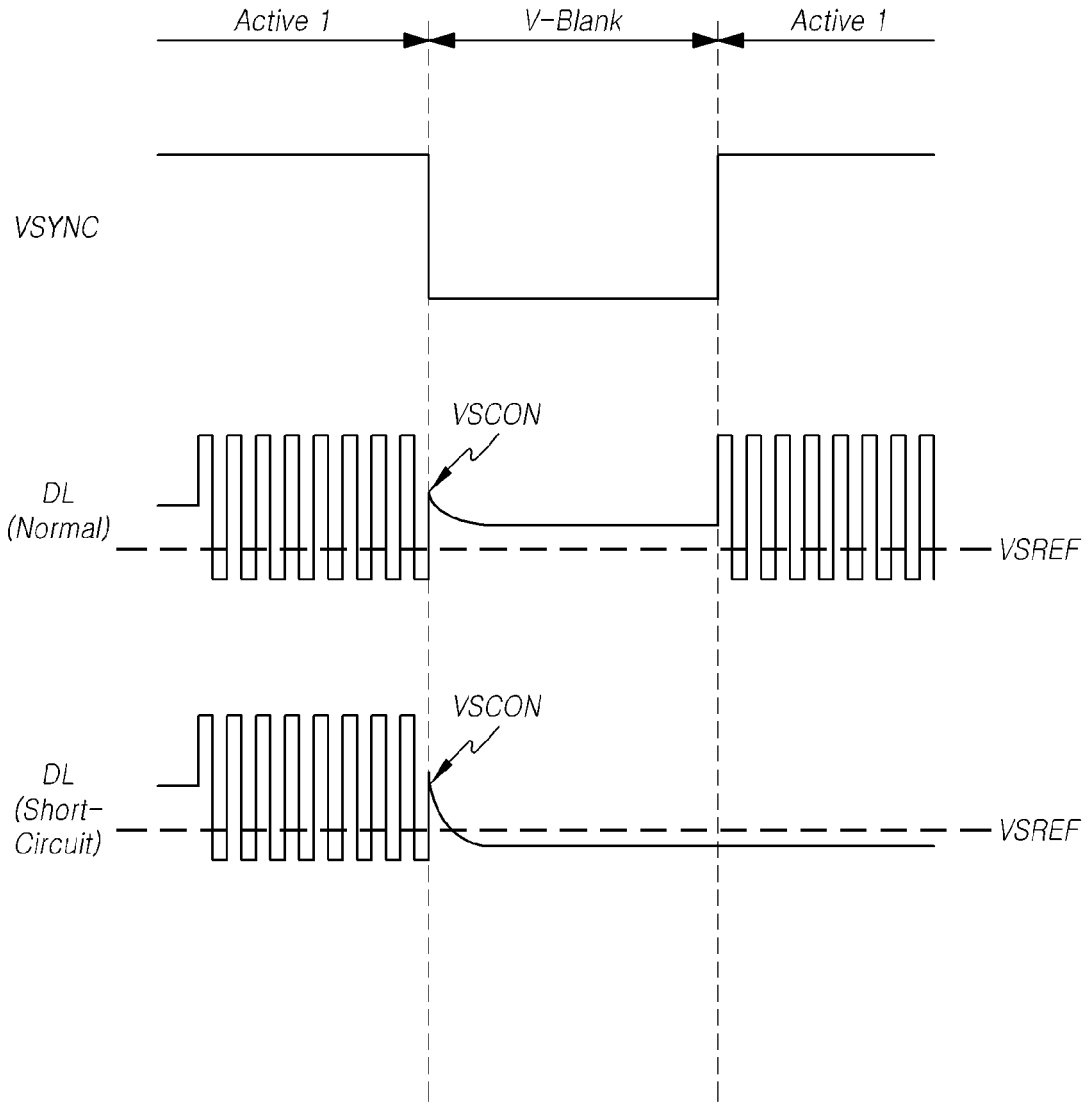
FIG. 9 is a diagram illustrating a method by which the data driver circuit according to exemplary aspects detects a short-circuit in the data line in a vertical blank period.
Figure 10:
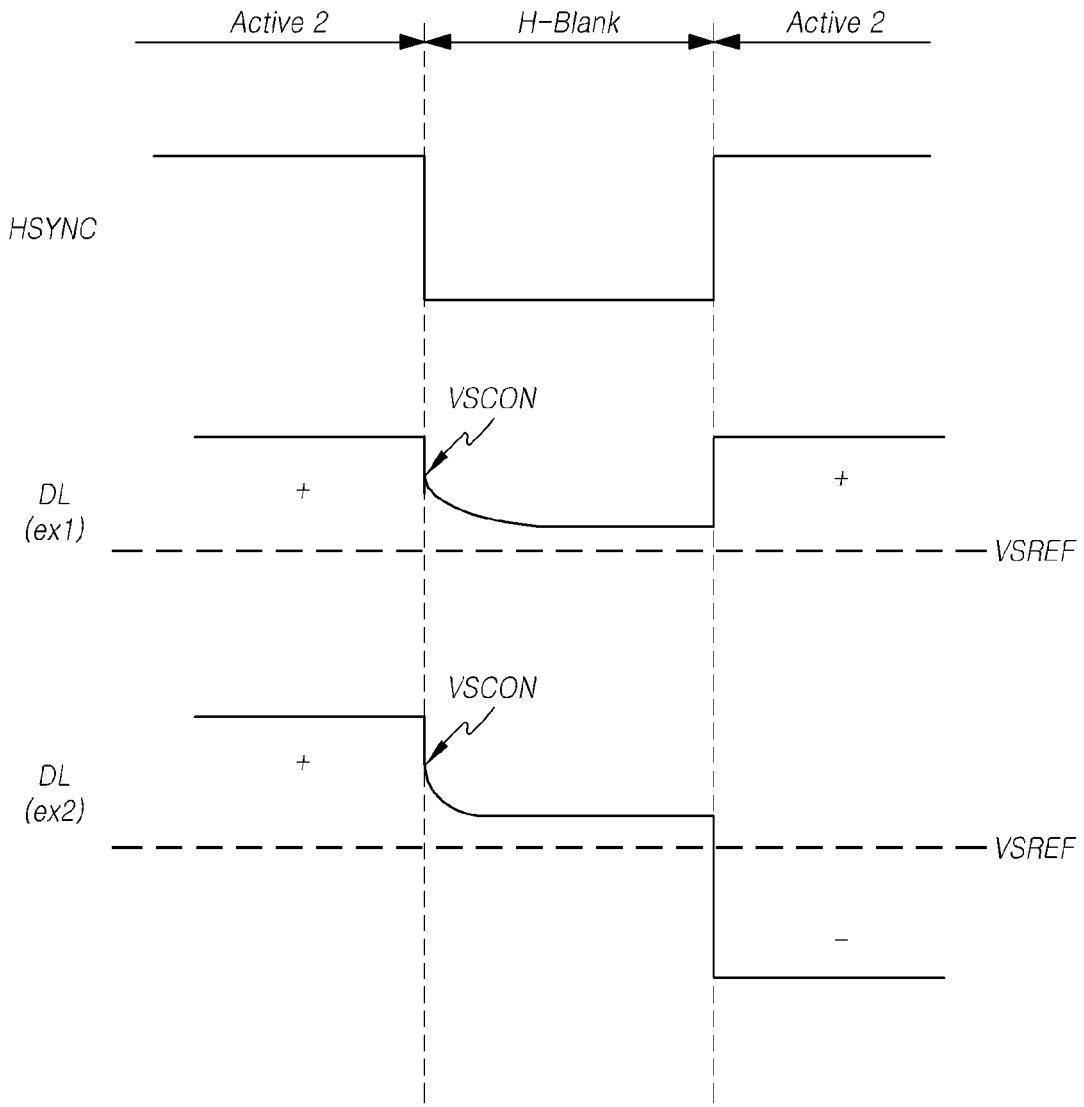
FIG. 10 is a diagram illustrating a method by which the data driver circuit according to exemplary aspects detects a short-circuit in the data line in a horizontal blank period.

FIGS. 9 and 10 are diagrams illustrating periods in which the data driver circuit 130 according to exemplary aspects detects a short-circuit in the data lines DL. In FIGS. 9 and 10, FIG. 9 is a diagram illustrating a case in which the short-circuit is detected in a vertical blank period V-Blank, while FIG. 10 is a diagram illustrating a case in which the short-circuit is detected in a horizontal blank period H-Blank.

Referring to FIG. 9, the data driver circuit 130 receives a vertical synchronization signal VSYNC from the controller 140, and outputs a data voltage or a detection set voltage VSCON to each of the data lines DL, based on the vertical synchronization signal VSYNC.

For example, the data driver circuit 130 may output the data voltage to the data line DL in a first active period Active 1, i.e. a period in which the vertical synchronization signal VSYNC has a high level, and output the detection set voltage VSCON to the data line DL in the vertical blank period V-Blank, i.e. a period in which the vertical synchronization signal VSYNC has a low level.

Here, the first active period Active 1 represents a period in which data voltages are output in the period of a single image frame, and may include the horizontal blank period H-B lank.

The data driver circuit 130 outputs the detection set voltage VSCON to the data line DL in the vertical blank period V-Blank. Since a scan signal having a turn-off level has been applied to each of the gate lines GL, the voltage of the data line DL, to which the detection set voltage VSCON is supplied, is gradually discharged.

Thus, the voltage level of the data line DL is gradually lowered during the vertical blank period V-Blank.

In this case, if a short-circuit is not generated in the data line DL, i.e. the data line DL is in a normal state, the degree, by which the voltage of the data line DL is lowered, is not significant during the vertical blank period V-Blank. That is, in the vertical blank period V-Blank, a voltage level detected from the data line DL, to which the detection set voltage VSCON is supplied, may be higher than a detection reference voltage VSREF.

Thus, if the voltage level of the data line DL detected in the vertical blank period V-Blank is higher than the detection reference voltage VSREF, the data driver circuit 130 may determine that the data line DL is in a normal state. In addition, in the first active period Active 1 after the vertical blank period V-Blank, a data voltage is output to the data line DL.

The short-circuit generated in the data line DL means that the data line DL, to which the detection set voltage VSCON is supplied in the vertical blank period V-Blank, is short-circuited with the common electrode COM or the like. Thus, resistance is lowered, and the degree, by which the voltage level of the data line DL is lowered, is significant. That is, the voltage level detected from the data line DL, to which the detection set voltage VSCON is supplied, in the vertical blank period V-Blank, may be lower than the detection reference voltage VSREF.

If the voltage level of the data line DL is lowered to be lower than the detection reference voltage VSREF in the vertical blank period V-Blank, the data driver circuit 130 stops the output of the data voltage to the corresponding data line DL during the first active period Active 1 after the vertical blank period V-Blank. Thus, the voltage level of the data line DL, detected as being short-circuited, may maintain the voltage level of the vertical blank period V-B lank.

Alternatively, if the vertical blank period V-Blank, in which the short-circuit in the data line DL is detected, continues a preset number of times or more, the output of data voltages to the corresponding data line DL may be stopped.

Accordingly, even in the case in which the voltage of the data line DL, to which the detection set voltage VSCON is supplied, become (is lowered) to be lower than the detection reference voltage VSREF in the vertical blank period V-Blank, the data voltage may be output to the corresponding data line in the first active period Active 1 right after the vertical blank period V-Blank. In addition, in the first active period Active 1 after the preset number of times, the output of data voltages may be stopped.

As described above, in a case in which the vertical blank period V-Blank, in which the short-circuit in the data line DL is detected, continues a preset number of times or more, the output of data voltages is stopped. Accordingly, this can improve the reliability of the short-circuit detection and the reliability of the control over the driving of the data driver circuit 130, due to the short-circuit detection.

In addition, the above-described operation of detecting a short-circuit in the data line DL may be performed in the horizontal blank period H-Blank in the period of a single image frame.

Referring to FIG. 10, the data driver circuit 130 may receive a horizontal synchronization signal HSYNC from the controller 140, and output a data voltage or a detection set voltage VSCON to each of the data lines DL, based on the horizontal synchronization signal HSYNC.

That is, during the period of a single image frame, the data driver circuit 130 may output the data voltage to the data line DL in a second active period Active 2 and the detection set voltage VSCON to the data line DL in the horizontal blank period H-Blank.

Here, in a case in which the data driver circuit 130 outputs data voltages to the data line DL by inverting the polarities thereof, the polarities of the data voltages supplied to the data line DL before and after the horizontal blank period H-Blank may be the same or different.

Example 1 (ex1) in FIG. 10 illustrates a case in which data voltages having the same polarity are supplied to the data line DL before and after the horizontal blank period H-Blank, in which detection of a short-circuit in the data line DL is performed.

The data driver circuit 130 outputs a data voltage having a first polarity (e.g. (+) polarity) in the second active period Active 2 before the horizontal blank period H-Blank. In addition, the data driver circuit 130 outputs the detection set voltage VSCON to the data line DL in the horizontal blank period H-Blank. After the horizontal blank period H-Blank, the data voltage having the first polarity (e.g. (+) polarity) is output to the data line DL.

The data driver circuit 130 may detect a voltage change in the data line DL, to which the detection set voltage VSCON is supplied, and detect a short-circuit in the data line DL in the horizontal blank period H-Blank.

That is, if no short-circuit is generated in the data line DL, the voltage of the data line DL, to which the detection set voltage VSCON is supplied, may be higher than the detection reference voltage VSREF during the horizontal blank period H-Blank. In addition, if no short-circuit is generated in the data line DL, the voltage of the data line DL may be lowered to be lower than the detection reference voltage VSREF.

The data driver circuit 130 may detect a short-circuit in the data line DL by detecting a voltage of the data line DL, to which the detection set voltage VSCON is supplied in the horizontal blank period H-Blank, and control the output of data voltages based on the result of detection.

Alternatively, data voltages supplied to the data line DL before and after the horizontal blank period H-Blank, in which the data driver circuit 130 outputs the detection set voltage VSCON to the data line DL, may have different polarities.

Referring to Example 2 (ex2) in FIG. 10, the data driver circuit 130 may output a data voltage having a first polarity (e.g. (+) polarity) to the data line in the second active period Active 2 before the horizontal blank period H-Blank, and output a data voltage having a second polarity (e.g. (−) polarity) to the data line in the second active period Active 2 after the horizontal blank period H-Blank.

Also in this case, the data driver circuit 130 may detect a short-circuit in the data line DL by outputting the detection set voltage VSCON to the data line DL in the horizontal blank period H-Blank and comparing the voltage of the data line DL with the detection reference voltage VSREF.

However, since data voltages having different polarities are supplied to the data line DL, in which short-circuit detection is performed in the horizontal blank period H-Blank, before and after the horizontal blank period H-Blank, a voltage change in the data line DL in the horizontal blank period H-Blank may be influenced. Thus, the short-circuit detection of the data line DL using the horizontal blank period H-Blank may be performed in the horizontal blank period H-Blank between the periods in which data voltages having the same polarity are supplied.

As described above, the data driver circuit 130 according to exemplary aspects may supply the detection set voltage VSCON to the data line DL in the vertical blank period V-Blank or the horizontal blank period H-Blank during display driving, and detect a short-circuit in the data line DL by comparing the voltage of the data line DL with the detection reference voltage VSREF in the blank period.

Here, the detection set voltage VSCON may cause a voltage change in the data line DL, and be set to be higher than the detection reference voltage VSREF.

In addition, the detection reference voltage VSREF may be determined in consideration of the level of a voltage change in the data line DL that would occur when the data line DL is short-circuited.

Figure 11:
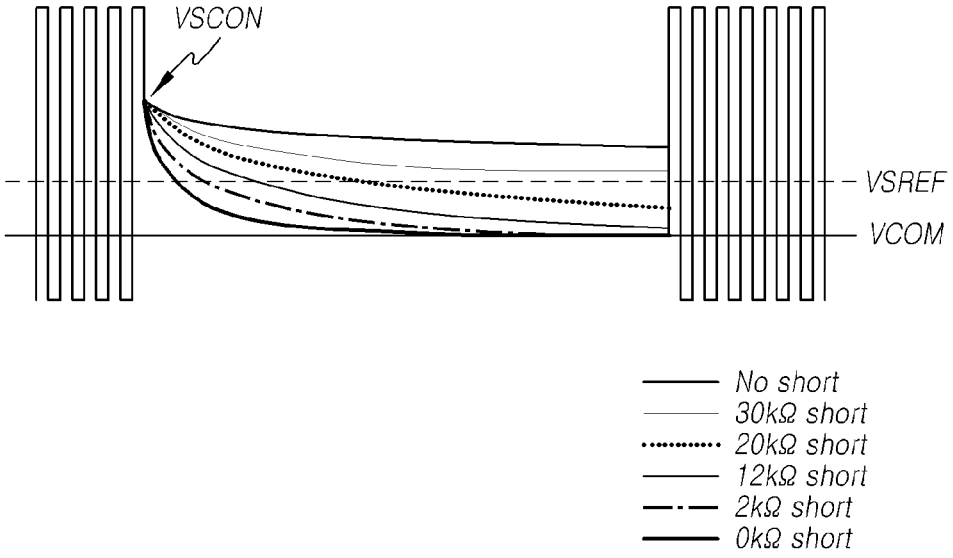
FIG. 11 is a diagram illustrating a detection reference voltage set in the data driver circuit according to exemplary aspects to detect a short-circuit in the data line.

FIG. 11 is a diagram illustrating a method of setting a detection reference voltage VSREF used to detect a short-circuit in the data line DL in the data driver circuit 130 according to exemplary aspects.

Referring to FIG. 11, when the data driver circuit 130 supplies the detection set voltage VSCON to the data line DL in the blank period, a voltage change in the data line DL may differ depending on the degree of short-circuit of the data line DL during the blank period.

For example, if a significant short-circuit is generated between the data line DL and the common electrode COM, the resistance of the data line DL may be close to 0 k?, and the voltage level of the data line DL in the blank period may be lowered to the level of a common voltage VCOM supplied to the common electrode COM.

In addition, if an insignificant short-circuit is generated between the data line DL and the common electrode COM, the resistance of the data line DL may not be low. In this case, the voltage of the data line DL, to which the detection set voltage VSCON is supplied, may be lowered by an insignificant degree in the blank period.

Here, when the insignificant short-circuit is generated between the data line DL, an insignificant amount of heat is generated due to the short-circuit. Thus, when the output of data voltages is stopped even in such cases, the operation of the display device 100 is unnecessarily limited.

Thus, the detection reference voltage VSREF, based on which a short-circuit in the data line DL is detected, may be set based on the resistance of the data line DL depending on the degree of the short-circuit and a voltage change in the data line DL depending on the resistance.

As illustrated in FIG. 11, the detection reference voltage VSREF may be set such that, if there is no short-circuit or the resistance of the data line DL is 30 k?, it is determined that no short-circuit is detected, and if the resistance of the data line DL is equal to or less than 20 k?, it is determined that a short-circuit is detected.

In addition, the detection reference voltage VSREF may be higher than the common voltage VCOM, supplied to the common electrode COM, by a certain level (e.g. 1 V).

As described above, the detection reference voltage VREF is set based on the resistance of the data line DL, i.e. the degree of the short circuit, in which heat capable of influencing the driving of the display device 100 is generated, in consideration of the resistance of the data line DL depending on the degree of the short-circuit and heat generation due to the resistance. Accordingly, it is possible to effectively perform the detection of the short-circuit in the data line and the operation control depending on the detection of the short-circuit.

Since the output of data voltages to the corresponding data line DL is stopped if the short-circuit in the data line DL is detected by the data driver circuit 130, the image may not be displayed in some area of the display panel 110.

In addition, a black image may be displayed in some area. Such an image appearing in the area, to which no data voltages are output due to the short-circuit in the data line DL, is referred to as a shut-down image.

Figure 12:
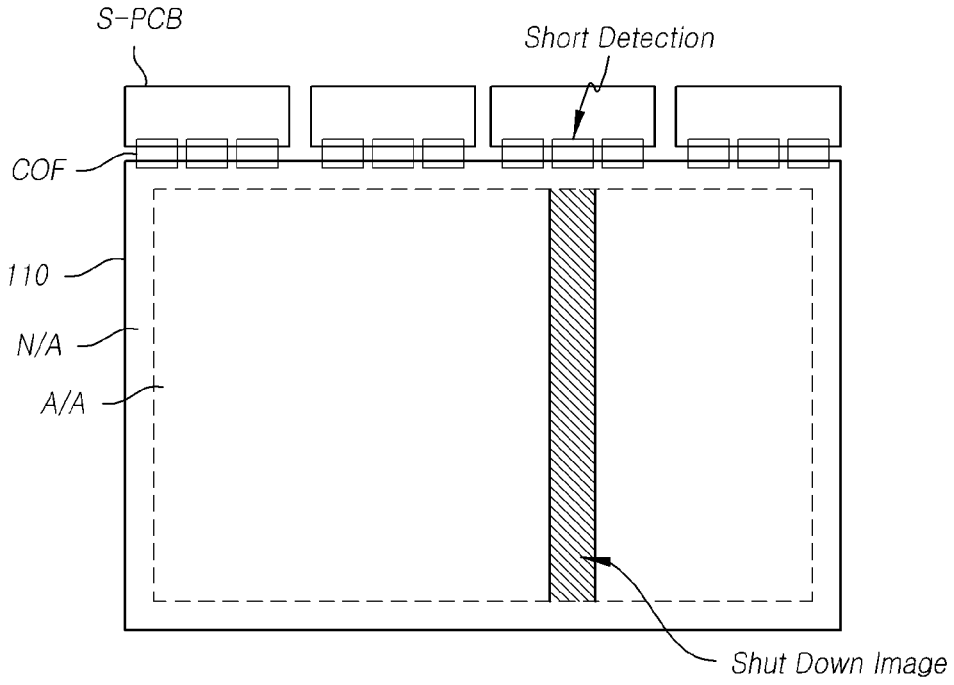
FIG. 12 is a diagram illustrating an image appearing on the display panel in a case in which the data driver circuit according to exemplary aspects performs a shut-down operation if a short-circuit is detected in the data line.

FIG. 12 is a diagram illustrating a shut-down image appearing on the display panel 110 in a case in which the data driver circuit 130 according to exemplary aspects stops the output of data voltages, i.e. performs a shut-down operation, if a short-circuit is detected in the data line DL.

Referring to FIG. 12, the display panel 110 includes an active area A/A in which images are displayed and a non-active area N/A in which the signal lines, the pads, or the circuits for driving the active area A/A are disposed.

In addition, the data driver circuit 130 may be disposed on one side of the display panel 110.

The data driver circuit 130 may be configured, for example, such that one portion thereof is attached to the display panel 110 and another portion thereof is mounted on a film attached to a source printed circuit board (S-PCB). That is, the data driver circuit 130 may be a plurality of source driver integrated circuits (SDICs) mounted on the film.

Here, during display driving, the plurality of SDICs detect a short-circuit in the data lines DL in the blank period. If a short-circuit is detected in a data line DL among the data lines DL in a blank period or the blank period in which the short-circuit is detected continues a preset number of times, a corresponding SDIC among the plurality of SDICs stops the output of data voltages to the corresponding data line DL.

Accordingly, as illustrated in FIG. 12, the supply of data voltages to all data lines DL, disposed in an area driven by the SDIC driving the short-circuited data line DL, is stopped. In addition, the area driven by the corresponding SDIC displays a shut-down image.

As described above, when the data driver circuit 130 stops the output of data voltages to certain data lines DL by detecting a short-circuit in at least one of the data lines DL, the shut-down image is displayed on the display panel 110. Accordingly, it is possible to detect a defect in the display device 100 and remove the defect before the device is damaged by heat.

Figure 13:
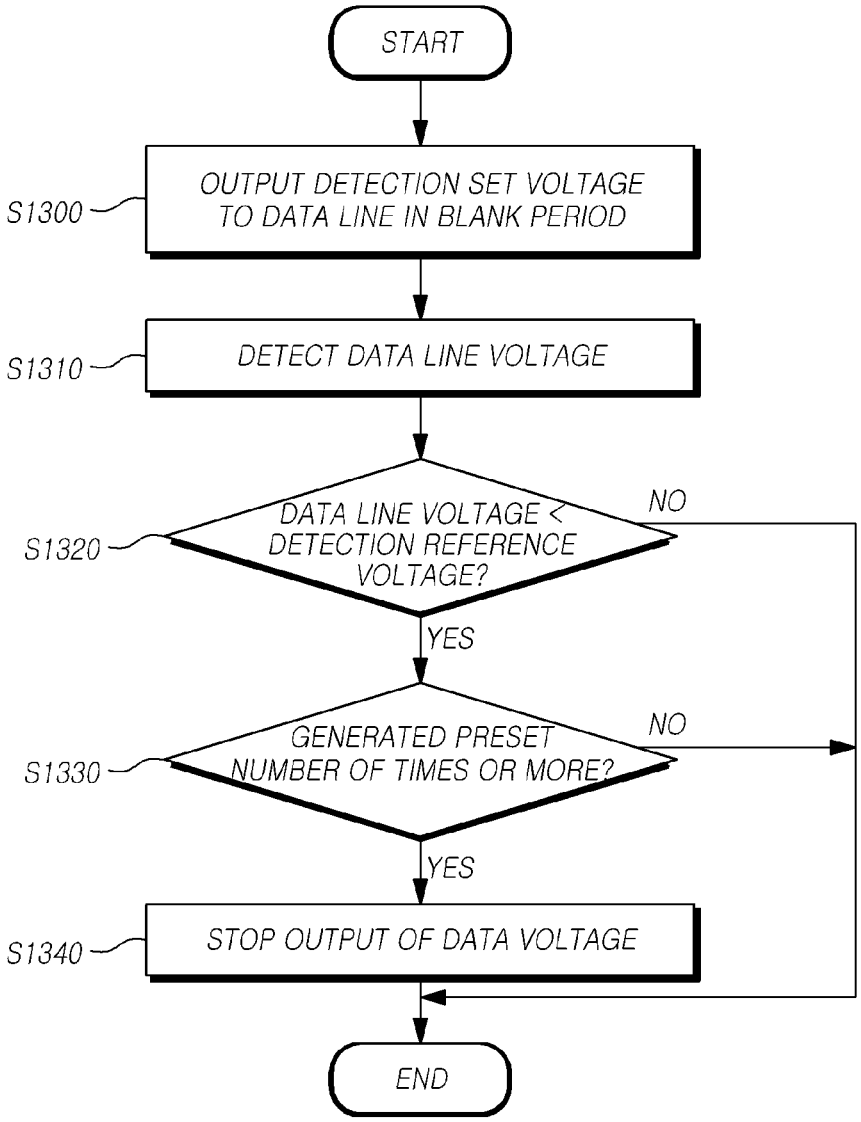
FIG. 13 is a flowchart illustrating a method of driving the data driver circuit according to exemplary aspects.

FIG. 13 is a flowchart illustrating a method of driving the data driver circuit 130 according to exemplary aspects.

Referring to FIG. 13, in S1300, the data driver circuit 130 according to exemplary aspects outputs a detection set voltage VSCON to the data lines DL in a blank period, such as a vertical blank period V-Blank or a horizontal blank period H-Blank, during display driving.

In addition, in S1310, voltages of the data lines DL are detected during the blank period.

If a voltage of a data line DL among the data lines DL, detected in the blank period, is lower than a detection reference voltage VSREF in S1320, it may be detected that a short-circuit is generated in the corresponding data line DL.

In addition, if the blank period, in which the short-circuit is detected in the data line DL, is determined as continuously or discontinuously occurring a preset number of times or more in S1330, the data driver circuit 130 stops the output of data voltages to the data line DL in S1340.

The data driver circuit 130 according to exemplary aspects outputs the detection set voltage VSCON to the data line DL in the blank period and detects a voltage change in the data line DL during the blank period, so that a short-circuit in the data line DL can be detected during display driving.

In addition, if the short-circuit in the data line DL is detected and is repeated a certain number of times or more, the output of data voltages to the corresponding data line is stopped, so that the driver circuits and the display panel 110 can be protected before heat generation due to the short-circuit in the data line DL is intensified.

The foregoing descriptions and the accompanying drawings have been presented in order to explain certain principles of the present disclosure by way of example. A person having ordinary skill in the art to which the present disclosure relates could make various modifications and variations without departing from the principle of the present disclosure. The foregoing aspects disclosed herein shall be interpreted as being illustrative, while not being limitative, of the principle and scope of the present disclosure. It should be understood that the scope of the present disclosure shall be defined by the appended claims and all of their equivalents fall within the scope of the present disclosure.

What is claimed is:

1. A display device comprising: a display panel in which a plurality of gate lines, a plurality of data lines, and a plurality of subpixels are disposed;

a gate driver circuit driving the plurality of gate lines; and a data driver circuit driving the plurality of data lines, wherein the data driver circuit outputs a detection set voltage to at least one data line among the plurality of data lines during a blank period, and the detection set voltage is higher than a detection reference voltage, and wherein the data driver circuit stops outputting a data voltage to the at least one data line during at least one period of active periods after the blank period when a voltage of the at least one data line which the detection set voltage is supplied to be lower than the detection reference voltage during the blank period.

2. The display device according to claim 1, wherein the data driver circuit comprises:

a plurality of first switches respectively connected with the plurality of data lines and an output end of the data voltage; and a plurality of second switches respectively connected with the plurality of data lines and a detection circuit, wherein the plurality of second switches is turned on during the blank period.

3. The display device according to claim 2, wherein, when a voltage of the at least one data line among the plurality of data lines where the detection set voltage is supplied becomes lower than the detection reference voltage during the blank period, at least one first switch among the plurality of first switches connected to the at least one data line is turned off.

4. The display device according to claim 1, wherein the data driver circuit stops outputting the data voltage to the at least one data line when the blank period continues a preset number of times or more, and wherein a voltage of the at least one data line where the detection set voltage is supplied becomes lower than the detection reference voltage during the blank period.

5. The display device according to claim 1, wherein the data driver circuit outputs the detection set voltage during a vertical blank period between image frame periods.

6. The display device according to claim 1, wherein the data driver circuit outputs the detection set voltage in a horizontal blank period in a single image frame.

7. The display device according to claim 6, wherein the data driver circuit outputs the detection set voltage during the horizontal blank period between a first period in which the data voltage having a first polarity is output in the single image frame and a second period in which the data voltage having the first polarity is output, and wherein the second period is continuous with the first period.

8. The display device according to claim 1, wherein the detection reference voltage is higher than a common voltage supplied to a common electrode.

9. The display device according to claim 1, wherein the gate driver circuit outputs a scan signal having a turn-off level to the plurality of gate lines.

10. The display device according to claim 1, wherein the display panel displays a shut-down image in at least one area when a voltage of the at least one data line, to which the detection set voltage is supplied, becomes lower than the detection reference voltage during the blank period.

11. A display panel comprising: a plurality of gate lines arranged in a single direction; a plurality of data lines intersecting the plurality of gate lines; and a plurality of subpixels defined by intersections of the plurality of gate lines and the plurality of data lines, wherein the data driver circuit outputs a detection set voltage to at least one data line among the plurality of data lines during a blank period, and the detection set voltage is higher than a detection reference voltage, and wherein the data driver circuit stops outputting a data voltage to the at least one data line during at least one period of active periods after the blank period when a voltage of the at least one data line which the detection set voltage is supplied to be lower than the detection reference voltage during the blank period.

12. The display panel according to claim 11, wherein the voltage level of the at least one data line is lowered during the blank period and the lowered voltage level is maintained after the blank period.

13. The display device according to claim 11, wherein the data driver circuit stops outputting the data voltage to the at least one data line when the blank period continues a preset number of times or more, and wherein a voltage of the at least one data line where the detection set voltage is supplied becomes lower than the detection reference voltage during the blank period.

14. A data driver circuit comprising: a voltage output circuit outputting a detection set voltage to at least one data line among a plurality of data lines during a blank period, wherein the detection set voltage is higher than a detection reference voltage; a detection circuit detecting a voltage of the at least one data line where the detection set voltage is supplied during the blank period; and a control circuit stopping outputting a data voltage to the at least one data line during at least one period of active periods after the blank period when a voltage of the at least one data line where the detection set voltage is applied becomes lower than the detection reference voltage during the blank period.

15. The data driver circuit according to claim 14, further comprising:

a plurality of first switches respectively connected with the plurality of data lines and the voltage output circuit; and a plurality of second switches respectively connected with the plurality of data lines and the detection circuit, wherein the plurality of second switches is turned on during the blank period.

16. The data driver circuit according to claim 15, wherein, 4 when a voltage of the at least one data line among the plurality of data lines where the detection set voltage is supplied becomes lower than the detection reference voltage during the blank period, at least one first switch among the plurality of first switches connected to the at least one data line is turned off.

17. The data driver circuit according to claim 15, wherein the control circuit outputs a turn-on signal to the plurality of second switches during the blank period, and when the voltage of the at least one data line, to which the detection set voltage is applied, become lower than the detection reference voltage during the blank period, outputs a turn-off signal to the at least one first switch, among the plurality of first switches during the blank period or during an active period after the blank period.

18. The data driver circuit according to claim 15, wherein the control circuit outputs a high level signal to the plurality of second switches during the blank period, and outputs a low level signal to the plurality of second switches during periods other than the blank period.

19. The data driver circuit according to claim 14, wherein the control circuit receives at least one of a start signal of the blank period, an end signal of the blank period, and level information of the detection set voltage from an external source.

20. The data driver circuit according to claim 14, wherein the control circuit receives level information of the detection set voltage during the blank period.

* * * * *